US006749544B1

(12) United States Patent
Chen

(10) Patent No.: US 6,749,544 B1
(45) Date of Patent: Jun. 15, 2004

(54) RESISTANCE ADJUSTMENT DEVICE FOR AN EXERCISE APPARATUS

(76) Inventor: Chin-Jung Chen, No. 24, Alley 52, Lane 154, Chung-Ching Rd., Taichung City (TW)

( * ) Notice: Subject to any disclaimer, the term of this patent is extended or adjusted under 35 U.S.C. 154(b) by 0 days.

(21) Appl. No.: 10/418,679

(22) Filed: Apr. 17, 2003

(51) Int. Cl.[7] ..... A63B 22/06; A63B 69/16
(52) U.S. Cl. ..... 482/57; 482/65
(58) Field of Search ..... 482/57–65

(56) References Cited

U.S. PATENT DOCUMENTS 4,235,436 A * 11/1980 Lee ..... 482/63
4,289,309 A * 9/1981 Hoffmann ..... 482/63
4,291,872 A * 9/1981 Brilando et al. ..... 482/57
4,438,921 A * 3/1984 Szymski ..... 482/57
6,612,970 B2 * 9/2003 Forcillo ..... 482/57

* cited by examiner

*Primary Examiner*—Stephen R. Crow
(74) *Attorney, Agent, or Firm*—Christie, Parker & Hale, LLP

(57) ABSTRACT

A resistance adjustment device for an exercise apparatus includes first and second swing arms connected pivotally and respectively to a front support frame, and two brake devices connected respectively to the first and second swing arms. When an adjustment knob is operated, a first cable can be loosened and pulled so that the first and second swing arms can move the brake devices away from and toward a flywheel, thereby adjusting magnitude of resistance to rotation of the flywheel. When a brake lever is operated, a second cable can be swiftly pulled so that the first and second swing arms can move the brake devices toward the flywheel so as to effect an instant brake.

6 Claims, 9 Drawing Sheets

RESISTANCE ADJUSTMENT DEVICE FOR AN EXERCISE APPARATUS

BACKGROUND OF THE INVENTION

1. Field of the Invention

The invention relates to an exercise apparatus, more particularly to an exercise apparatus with a resistance adjustment device for adjusting magnitude of resistance to rotation of a flywheel.

2. Description of the Related Art

Referring to FIGS. 1 and 2, a conventional exercise apparatus 10 is shown to include a front support frame 11 having two fixed upright rods 111, a rear support frame 12, a bottom connecting rod 13 interconnecting the front and rear support frames 11, 12, a seat assembly 14 mounted adjustably on the rear support frame 12, a handle assembly 15 mounted on the front support frame 11, a flywheel 16 mounted rotatably between the upright rods 111 of the front support frame 11, a pedal unit 17 mounted on the rear support frame 12 for actuating rotation of the flywheel 16, and a resistance adjustment unit 20 for adjusting magnitude of resistance to rotation of the flywheel 16.

The adjustment unit 20 includes a fixed seat 21 mounted fixedly between the upright rods 111 and located above the flywheel 16, a pivot shaft 22 mounted on the fixed seat 21, two brake arms 23, 24 sleeved rotatably on the pivot shaft 22, two brake shoes 25 connected respectively to the brake arms 23, 24 and flanking the flywheel 16, an adjustment knob 26 disposed operably on the front support frame 11, and a cable 27 disposed between the adjustment knob 26 and the brake arms 23, 24. When the knob 26 is operated to loosen or tighten the cable 27, the brake arms 23, 24 are actuated to move the brake shoes 25 away from or toward the flywheel 16 so that adjustment of the magnitude of the resistance to the rotation of the flywheel 16 can be effected.

Although the adjustment unit 20 of the conventional exercise apparatus 10 can achieve its intended purpose, it has the following disadvantages:

1. The adjustment unit 20 is not designed to have an instant brake function. During pedaling exercise, two pedals 171 (only one is visible in FIG. 1) of the pedal unit 17 cannot stop rotation unless the flywheel 16 stops so that injury to users due to movement of the pedals 171 cannot be avoided.

2. Since each of the brake shoes 25 is connected to the respective one of the brake arms 23, 24 by means of a single screw-and-nut fastener 251, the brake shoes 25 can easily deflect so that contact with the flywheel 16 is not complete, thereby leading to ineffective adjustment of the magnitude of resistance to flywheel rotation.

3. Since tolerances exist during production and assembly of the brake arms 23, 24, and since the brake shoes 25 are directly connected to the brake arms 23, 24, when positions of the brake arms 23, 24 deflect, the brake shoes 25 cannot accommodate the position deviation. As such, the brake shoes 25 cannot contact the flywheel 16 completely.

SUMMARY OF THE INVENTION

Therefore, the main object of the present invention is to provide a resistance adjustment device for an exercise apparatus that permits adjustment of magnitude of resistance to flywheel rotation at different speeds and that can permit an instant brake so as to enhance safety.

Another object of the present invention is to provide a resistance adjustment device for an exercise apparatus which includes brake shoes that can be brought into complete contact with a flywheel so as to effectively brake the flywheel.

According to this invention, a resistance adjustment device is to be adapted for use with an exercise apparatus. The exercise apparatus includes a front support frame having two fixed upright rods, a rear support frame, a handle assembly mounted on the front support frame, a flywheel mounted rotatably between the upright rods of the front support frame, a seat assembly mounted on the rear support frame, and a pedal unit for actuating rotation of the flywheel. The resistance adjustment device comprises first and second swing arms, two biasing units, two brake devices, a first adjustment unit, and a second adjustment unit. The first and second swing arms are adapted to be connected pivotally and respectively to the upright rods of the front support frame, are adapted to flank the flywheel, and are rotatable toward and away from the flywheel. Each of the biasing units is adapted to be disposed between a respective one of the upright rods and a respective one of the first and second swing arms so as to bias the first and second swing arms to rotate away from the flywheel. The brake devices are connected respectively to the first and second swing arms, and are located on two sides of the flywheel. The first adjustment unit has an adjustment knob adapted to be mounted rotatably on the front support frame, a tubular first guiding member connected fixedly to the first swing arm, a first fixing member connected fixedly to the second swing arm, and a first cable fastened to the adjustment knob at one end and to the first fixing member at another end. The first cable has an intermediate portion extending through the first guiding member. The second adjustment unit includes a brake lever adapted to be mounted operably on the handle assembly, a tubular second guiding member connected fixedly to the second swing arm, a second fixing member connected fixedly to the first swing arm, and a second cable fastened to the brake lever at one end and to the second fixing member at another end. The second cable has an intermediate portion that extends through the second guiding member. When the adjustment knob is operated, the first cable can be loosened and pulled so that the first and second swing arms can move the brake devices away from and toward the flywheel, thereby adjusting magnitude of resistance to rotation of the flywheel. When the brake lever is operated, the second cable can be swiftly pulled so that the first and second swing arms can move the brake devices toward the flywheel so as to clamp the flywheel to effect an instant brake.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
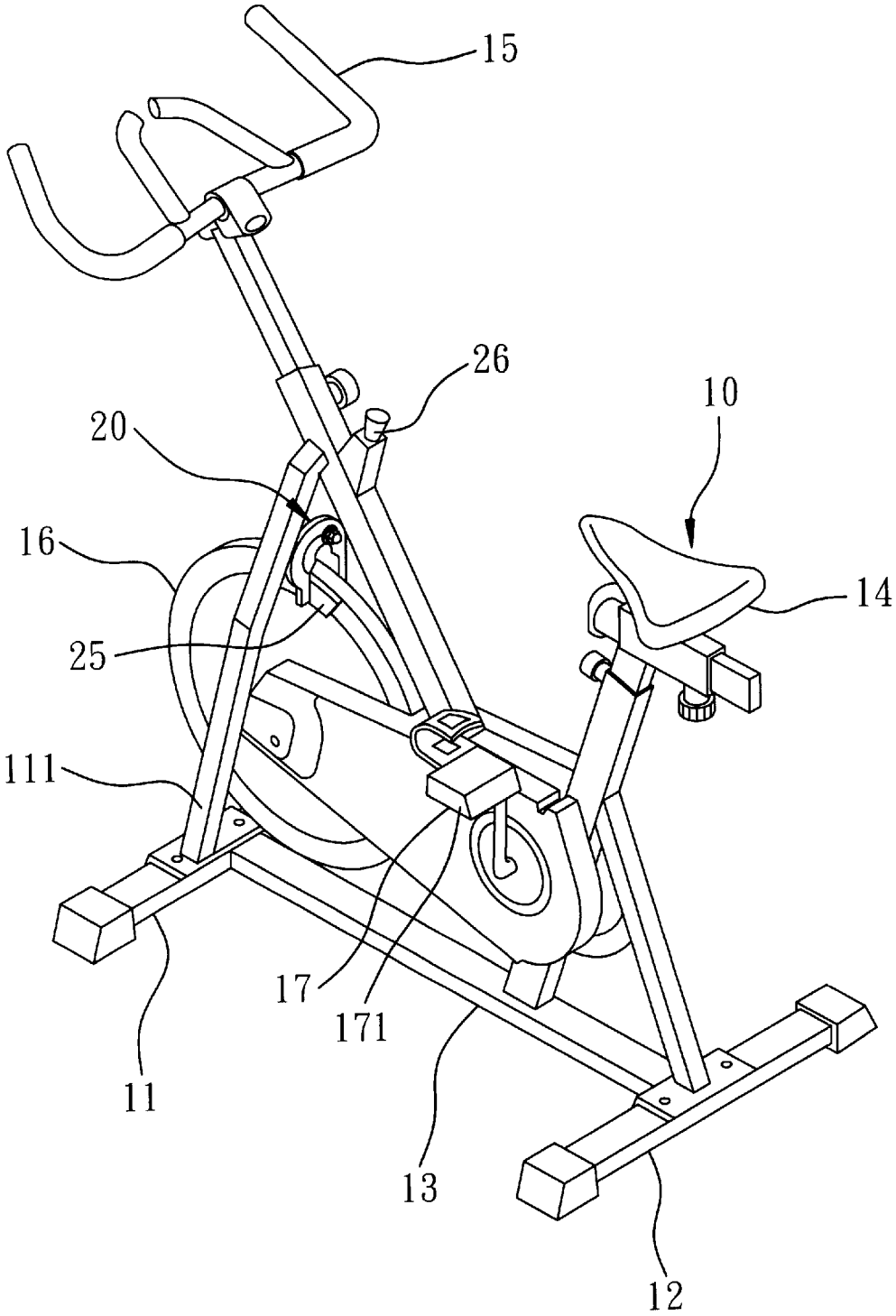
FIG. 1 PRIOR ART
FIG. 1 is a perspective view of a conventional exercise apparatus.
Figure 2:
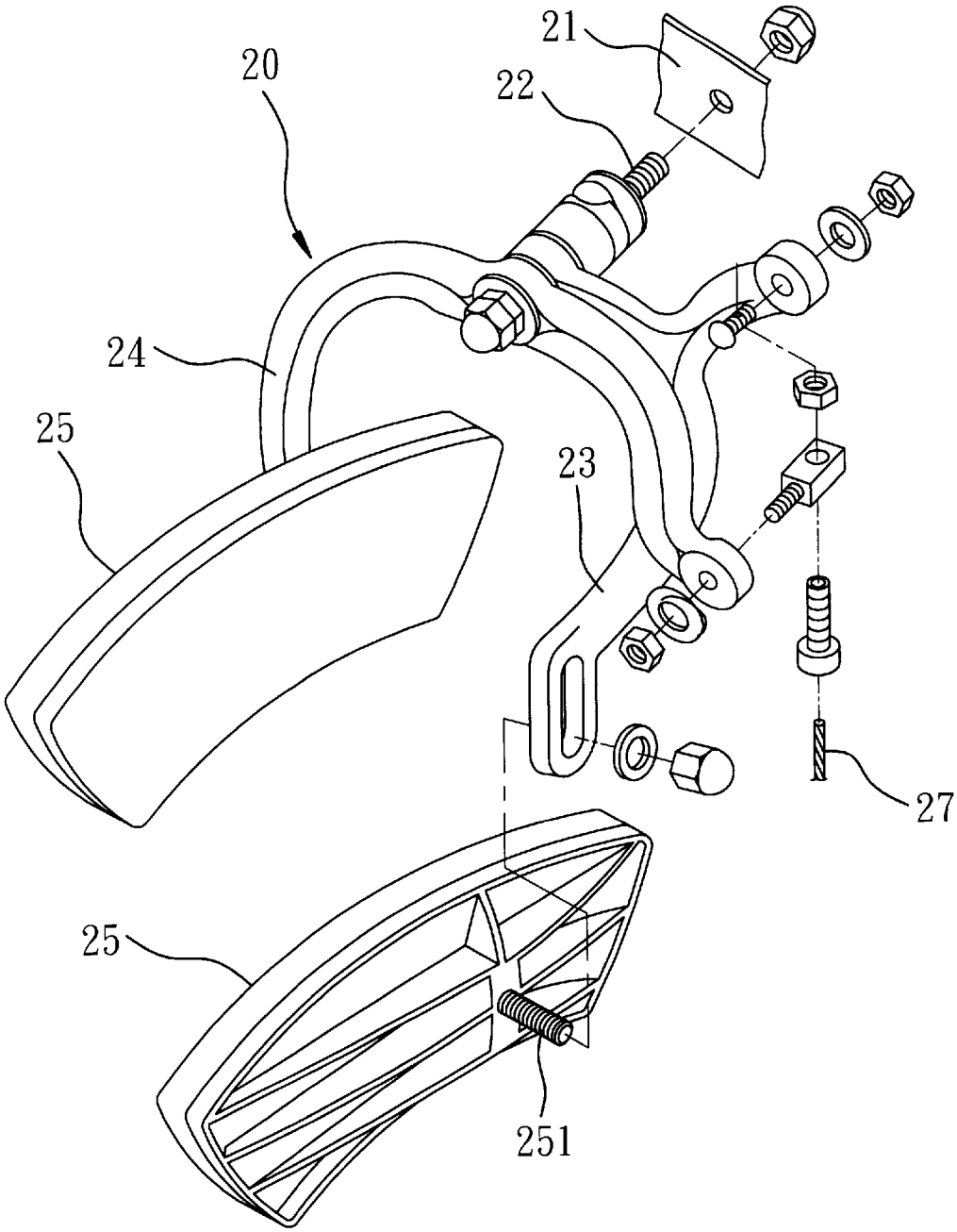
FIG. 2 PRIOR ART
FIG. 2 is a partly exploded perspective view of a resistance adjustment unit of the conventional exercise apparatus of FIG. 1.

Before the present invention is described in greater detail, it should be noted that like elements are denoted by the same reference numerals throughout the disclosure.

Referring to FIGS. 3 to 6, the first preferred embodiment of a resistance adjustment device according to the present invention is shown to be adapted for use with an exercise apparatus 30. The exercise apparatus 30 includes a front support frame 31 having two fixed upright rods 311, a rear support frame 32, a handle assembly 33 mounted on the front support frame 31, a flywheel 34 mounted rotatably between the upright rods 311 of the front support frame 31, a seat assembly 35 mounted on the rear support frame 32, and a pedal unit 36 for actuating rotation of the flywheel 34. The exercise apparatus 30 further includes two U-shaped support members 37 mounted fixedly and respectively on the upright rods 311 of the front support frame 31. The resistance adjustment device comprises first and second swing arms 40, 50, two biasing units 60 (see FIG. 4) two brake devices 70, a first adjustment unit 80 (see FIG. 3), and a second adjustment unit 90 (see FIG. 3).

The first and second swing arms 40, 50 are adapted to be connected pivotally and respectively to the support members 37 by means of a pivot assembly 100 (see FIGS. 4 and 6), are adapted to flank the flywheel 34, and are rotatable toward and away from the flywheel 34. Each of the first and second swing arms 40, 50 has an upper portion formed with first and second through holes 411, 511, 412, 512, and a lower portion formed with a third through hole 413, 513 (see FIGS. 4 and 6). In this embodiment, each pivot assembly 100 (see FIGS. 4 and 6) includes a sleeve 101 inserted fixedly into the respective third through hole 413, 513, and a shaft 102 having one end connected threadedly to the respective support member 37 and another end inserted into the corresponding sleeve 101, thereby connecting pivotally the first and second swing arms 40, 50 to the upright rods 311, respectively. Each of the first and second swing arms 40, 50 is formed with a fixed vertical mounting plate 42, 52 that has a vertically extending slot 421, 521 (only one vertically extending slot 421 is visible in FIG. 4) formed therethrough.

Each of the biasing units 60 (see FIG. 4) is adapted to be disposed between a respective one of the upright rods 311 and a respective one of the first and second swing arms 40, 50 so as to bias the first and second swing arms 40, 50 to rotate away from the flywheel 34. Each of the biasing units 60, in this embodiment, is a torsion spring, and includes a first leg 61 inserted into the respective one of the support members 37, and a second leg 62 inserted into the respective one of the first and second swing arms 40, 50 so that the first and second swing arms 40, 50 can be automatically restored to original positions.

The brake devices 70 (see FIGS. 4 and 6) are connected respectively to the first and second swing arms 40, 50, and are located on two sides of the flywheel 34. Each of the brake devices 70 includes a brake shoe 71 having a side surface formed with a groove 711, and a bolt and nut assembly connected fixedly to the respective one of the first and second swing arms 40, 50. The bolt and nut assembly of each of the brake devices 70 includes a bolt 72 and a nut 73. The bolt 72 has a transverse blocking plate 721, a non-threaded insert portion 722 that extends integrally and axially from one side of the blocking plate 721 and that is inserted fittingly into the groove 711 in the brake shoe 71, and a threaded shank portion 723 that extends integrally and axially from the other side of the blocking plate 721 and that extends through the slot 421, 521 in the mounting plate 42, 52 of the respective one of the first and second swing arms 40, 50. The nut 73 engages the shank portion 723 of the bolt 72 so as to clamp the mounting plate 42, 52 of the respective one of the first and second swing arms 40, 50 between the blocking plate 721 and the nut 73. The insert portion 722 of each of the bolts 72 has a semi-spherical outer end surface 7221 (see FIG. 6). Preferably, the groove 711 in each of the brake shoes 71 has a semi-spherical contour that corresponds to the outer end surface 7221 of the respective insert portion 722, and a depth shorter than the length of the corresponding insert portion 722 so that the brake shoe 71 of each brake device 70 can be brought into complete contact with the flywheel 34.

The first adjustment unit 80 (see FIGS. 3 to 6) has an adjustment knob 81 adapted to be mounted rotatably on the front support frame 31, a tubular first guiding member 85 connected fixedly to the first swing arm 40 by a bolt 83 that engages the second through hole 412 in the first swing arm 40, a first fixing member 84 disposed fixedly within the second through hole 512 in the second swing arm 50, and a first cable 82 fastened to the adjustment knob 81 at one end and to the first fixing member 84 at another end. The first guiding member 85 is constructed as a hollow bolt. The bolt 83 has a head portion with a screw hole 831 for engaging the first guiding member 85, and a threaded shank portion 832 for engaging a nut and a washer. The first cable 82 has an intermediate portion extending through the first guiding member 85. The first fixing member 84 is constructed as a lock bolt, and has a head portion 841, and a threaded shank portion with a through hole 842 formed proximate to the head portion 841 for extension of the first cable 82 therethrough.

Figure 7:
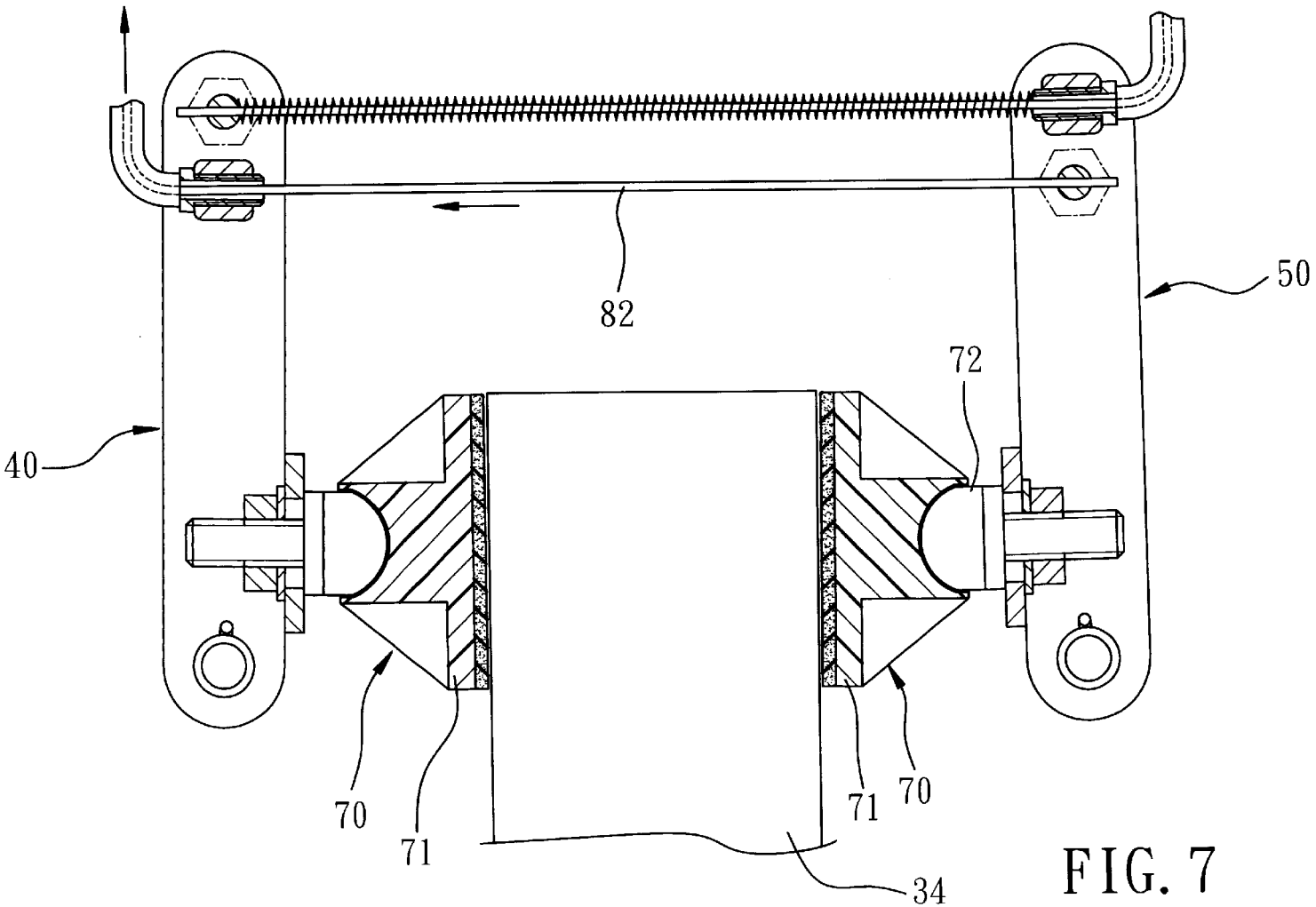
FIG. 7 is a view substantially similar to FIG. 6, illustrating how pulling of a first cable can result in movement of brake devices toward a flywheel.

Referring to FIG. 7, when the adjustment knob 81 is operated, the first cable 82 can be loosened and pulled so that the first and second swing arms 40, 50 can move the brake devices 70 away from and toward the flywheel 34, thereby adjusting magnitude of resistance to rotation of the flywheel 34.

The second adjustment unit 90 (see FIGS. 3 to 6) includes a brake lever 91 adapted to be mounted operably on the handle assembly 33, a tubular second guiding member 95 connected fixedly to the second swing arm 50 by a bolt 93 that engages the first through hole 511 in the second swing arm 50, a second fixing member 94 disposed fixedly within the first through hole 411 in the first swing arm 40, a second cable 92 connected to the brake lever 91 at one end and to the second fixing member 94 at another end, and a guide seat 96 adapted to be mounted fixedly on the front support frame 31 for extension of the second cable 92 therethrough so as to ensure smooth movement of the second cable 92. The second guiding member 95 is constructed as a hollow bolt. The bolt 93 has a head portion with a screw hole 931 for engaging the second guiding member 95. The second guiding member 95 permits extension of an intermediate portion of the second cable 92 therethrough. The second fixing member 94 is constructed as a lock bolt, and has a head portion 941 and a threaded shank portion 942 with a through hole 943 formed proximate to the head portion 941 for extension of the second cable 92 therethrough.

Figure 8:
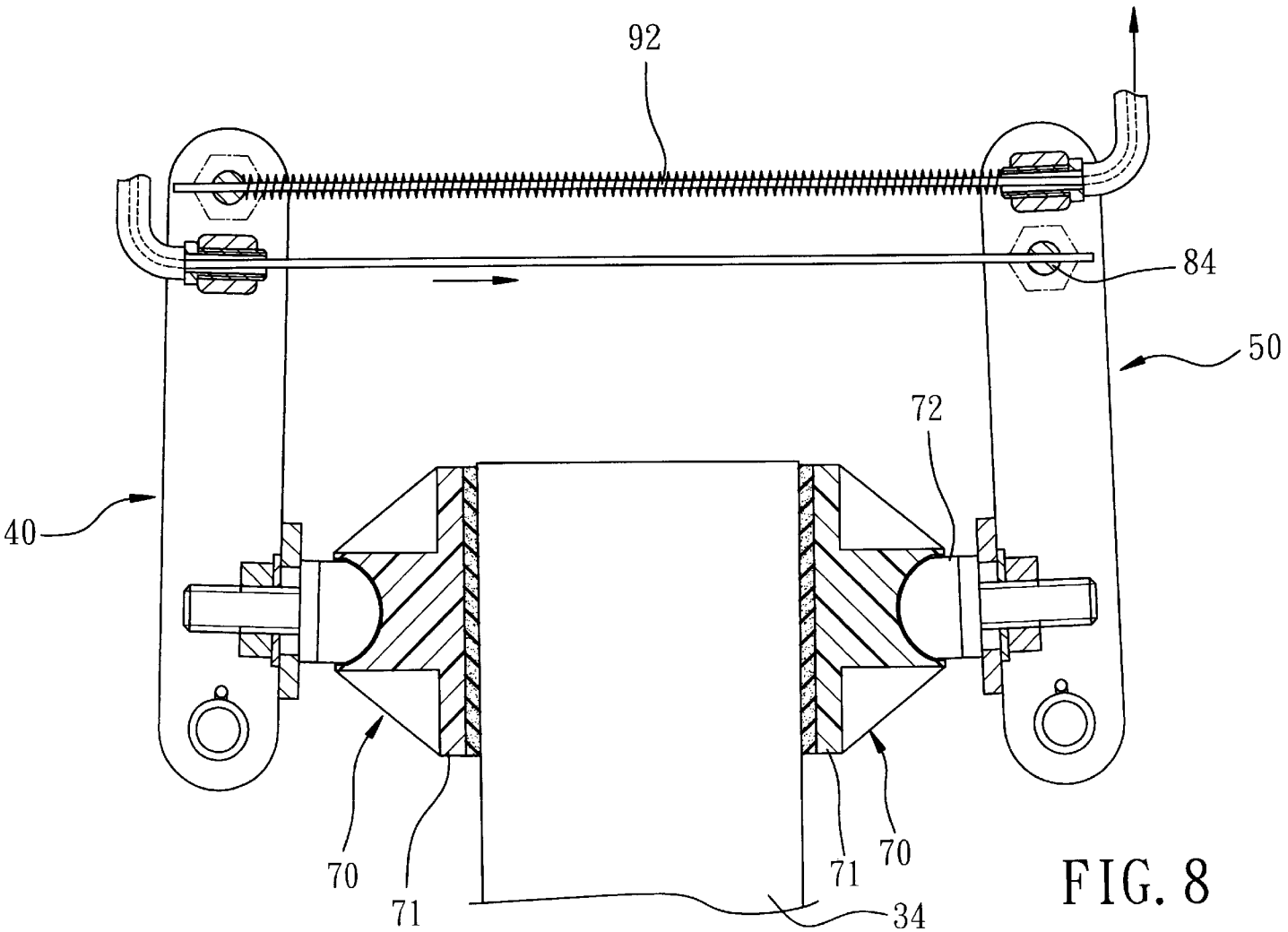
FIG. 8 is a view substantially similar to FIG. 6, illustrating how pulling of a second cable can result in an instant brake of the flywheel.

Referring to FIG. 8, when the brake lever 91 is operated, the second cable 92 can be swiftly pulled so that the first and second swing arms 40, 50 can move the brake devices 70 toward the flywheel 34 so as to clamp the flywheel 34 to effect an instant brake.

Referring again to FIG. 6, when a suitable distance is maintained between the flywheel 34 and the two brake shoes 71, the pedals 361 (only one is visible in FIG. 3) of the pedal unit 36 can be easily actuated.

Figure 3:
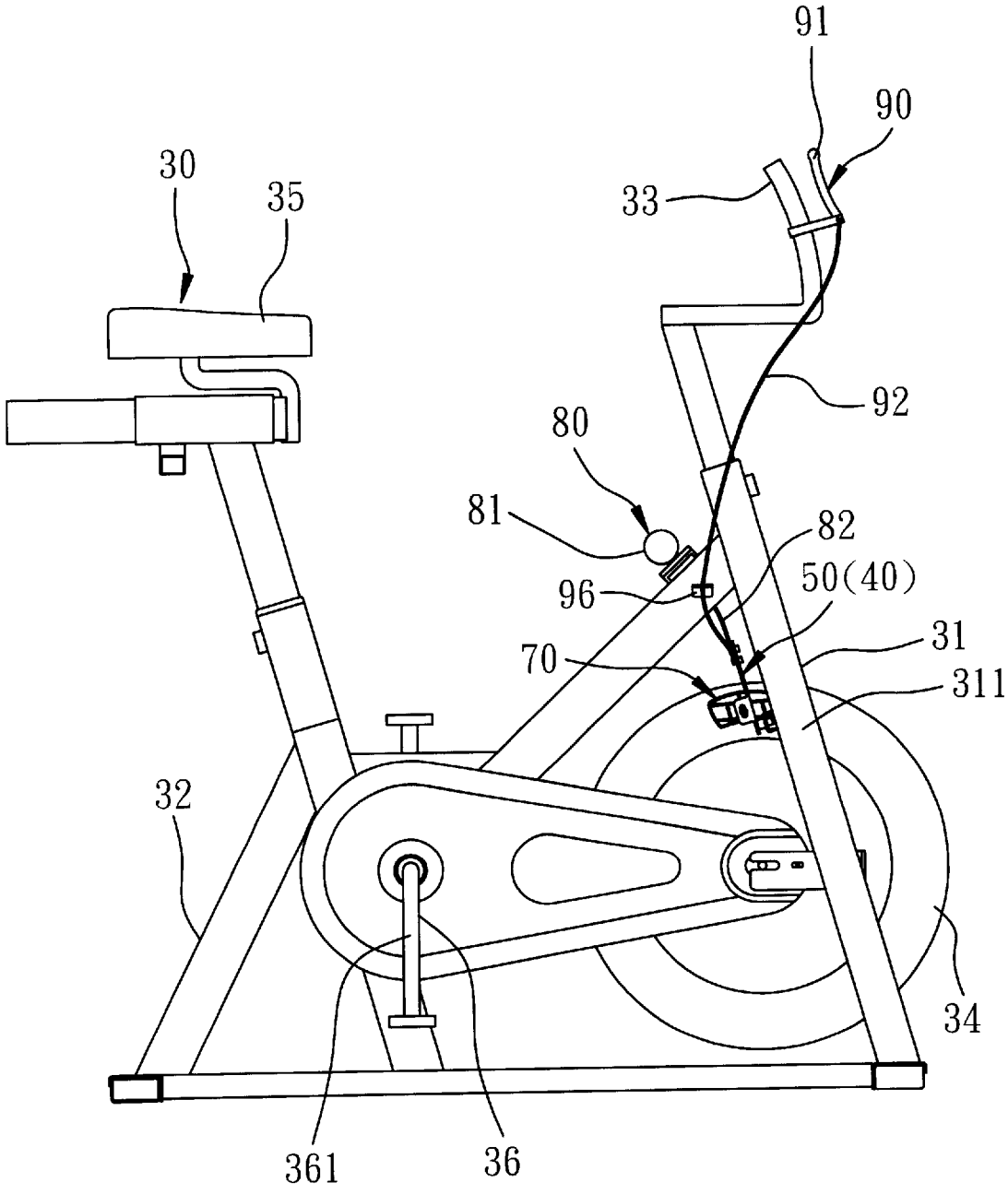
FIG. 3 is a schematic view of an exercise apparatus incorporating the first preferred embodiment of a resistance adjustment device according to the present invention.
Figure 4:
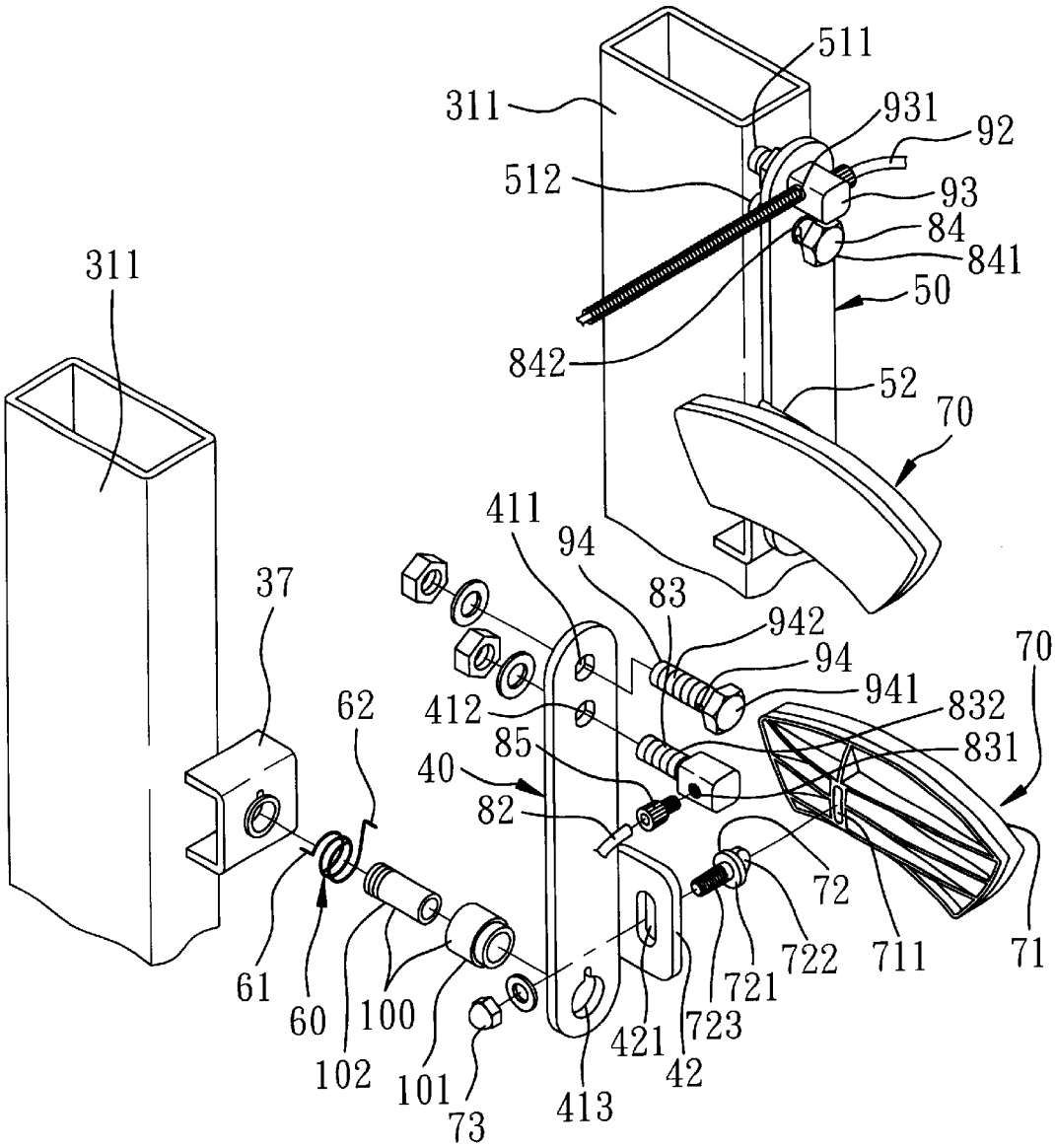
FIG. 4 is a partly exploded perspective view of the first preferred embodiment of the resistance adjustment device of this invention.
Figure 5:
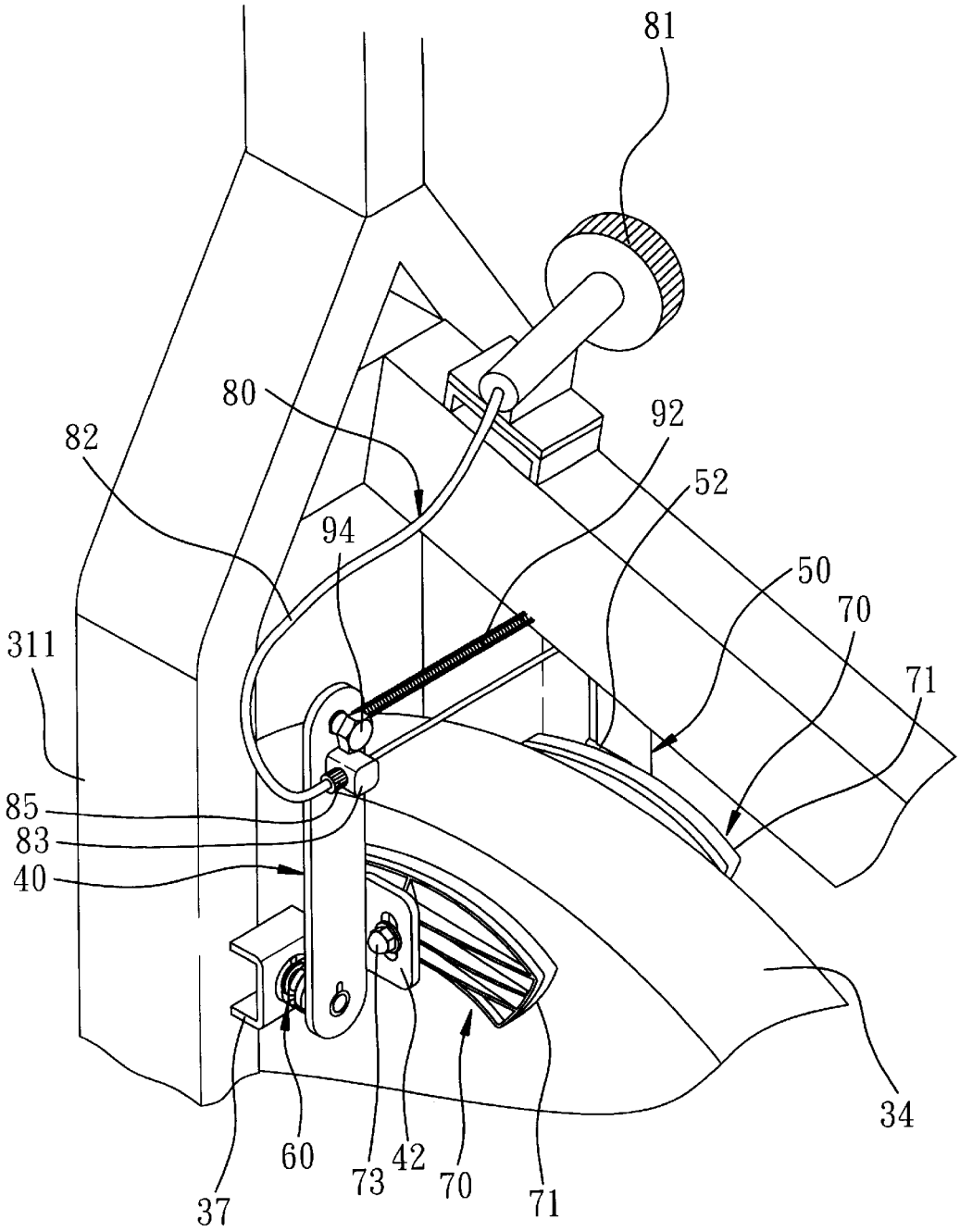
FIG. 5 is a fragmentary perspective view, illustrating how the first preferred embodiment is installed on the exercise apparatus.
Figure 6:
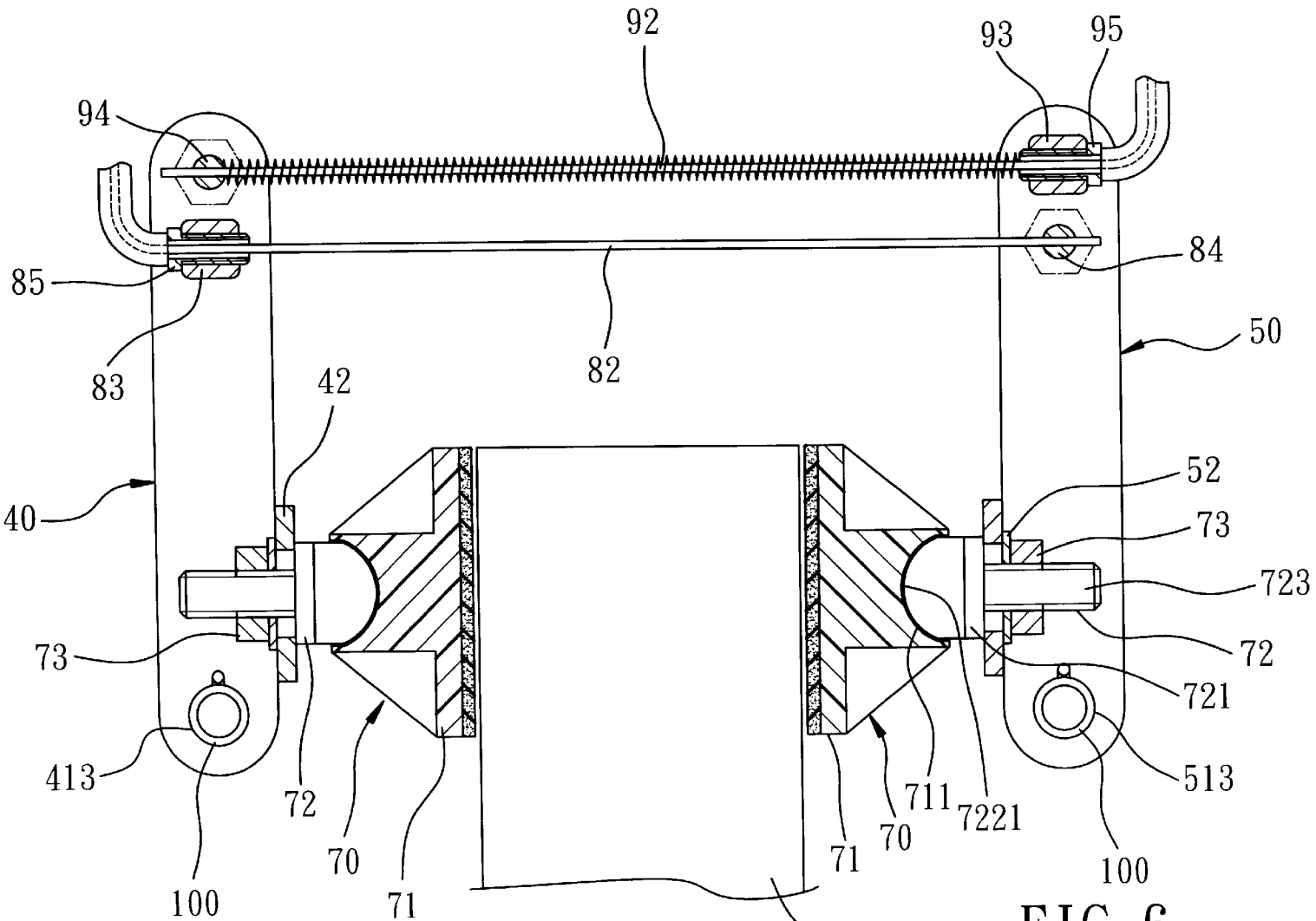
FIG. 6 is a schematic fragmentary sectional view of the first preferred embodiment in an assembled state.

Referring to FIG. 7, in combination with FIG. 3, when an increased resistance to rotation of the flywheel 34 and actuation of the pedal unit 36 is desired, the adjustment knob 81 is rotated in a clockwise direction so as to pull the first cable 82, which in turn, will actuate the first and second swing arms 40, 50 to move the two brake shoes 71 of the brake devices 70 toward the flywheel 34 so that the resistance applied to the flywheel 34 is increased. In contrast, when a decreased resistance is desired, the adjustment knob 81 is rotated in an opposite or counter clockwise direction so as to loosen the first cable 82, which in turn, will actuate the first and second swing arms 40, 50 to move the two brake shoes 71 away from the flywheel 34 so that the resistance applied to the flywheel 34 is reduced.

Referring to FIG. 8, in combination with FIG. 3, when an instant brake is desired to stop rotation of the flywheel 34, it is only necessary to operate the brake lever 91 so as to pull the second cable 92, which in turn, will actuate the first and second swing arms 40, 50 to move the two brake shoes 71 of the brake devices 70 toward and into contact with the flywheel 34. The two brake shoes 71 swiftly clamp the flywheel 34 at this time so that rotation of the flywheel 34 is stopped.

Figure 9:
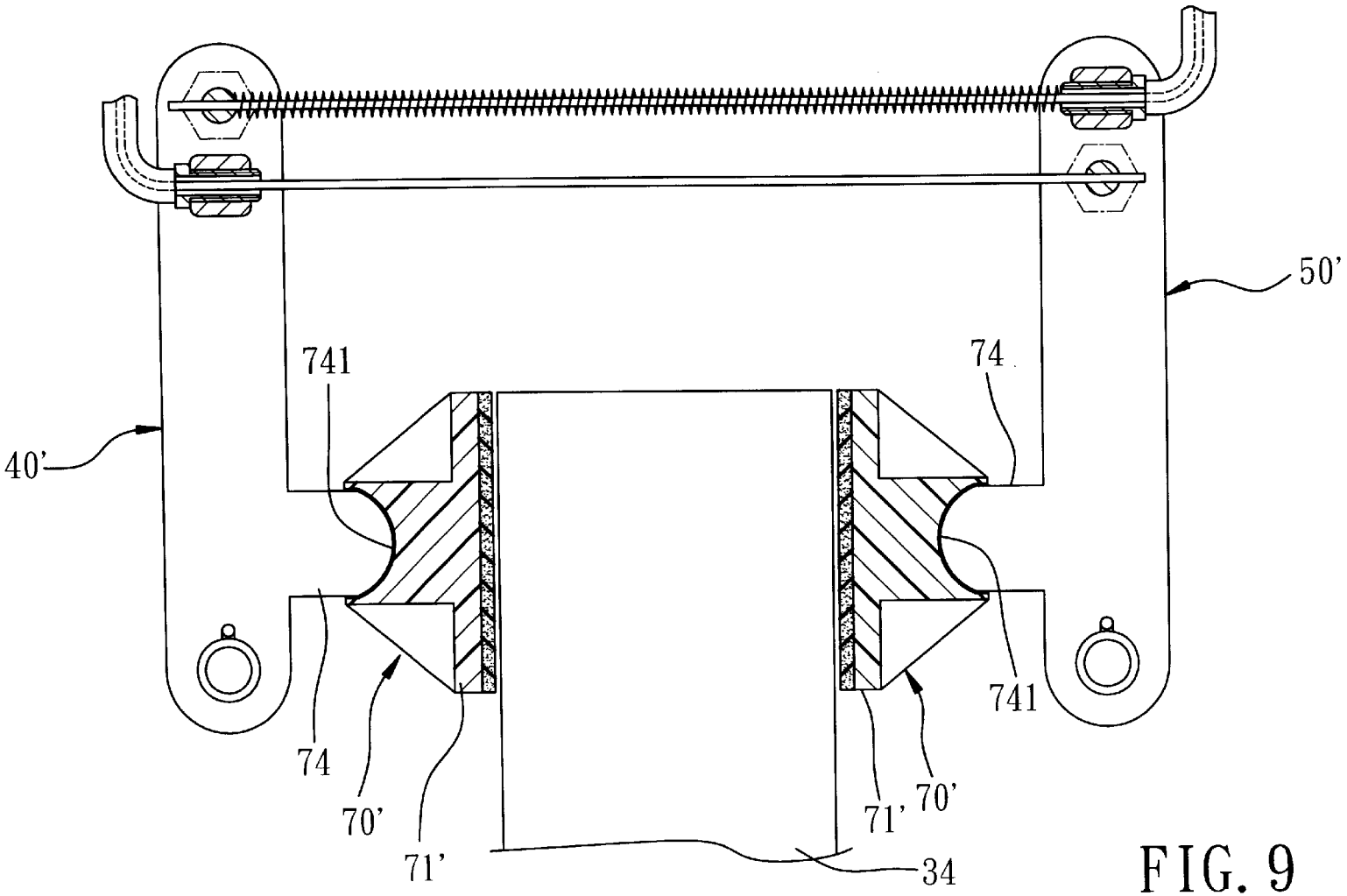
FIG. 9 is a view substantially similar to FIG. 6, illustrating modified brake devices of the second preferred embodiment of a resistance adjustment device according to the present invention.

Referring to FIG. 9, in combination with FIG. 3, the second preferred embodiment of a resistance adjustment device for an exercise apparatus 30 according to the present invention is shown to be substantially similar to the first preferred embodiment. However, in this embodiment, each of the brake devices 70' includes a brake shoe 71' having a side surface formed with a groove 711', and an insert piece 74 which is formed integrally with the respective one of the first and second swing arms 40', 50' and which is inserted into the groove 711' in the corresponding brake shoe 71' so that the brake shoe 71' is confined between the insert piece 74 and the flywheel 34. Each insert piece 74 has a semi-spherical outer end surface 741. The groove 711' in each of the brake shoes 71' has a semi-spherical contour that corresponds to the outer end surface 741 of the respective insert piece 74 so that the brake shoe 71' of each brake device 70' can be brought into complete contact with the flywheel 34.

The advantages of the resistance adjustment device of the present invention can be summarized as follows:

1. Because of the presence of the first adjustment unit 80 and the second adjustment unit 90, the magnitude of resistance to rotation of the flywheel 34 can be adjusted at different speeds, and instant brake can be applied so that rotation of the flywheel 34 can be swiftly stopped, thereby enhancing safety during use.

2. Because the two brake shoes 71 are connected respectively to the first and second swing arms 40, 50 by engagement of the semi-spherical outer end surface 7221, 741 and the semi-spherical groove 711, 711', the brake shoes 71 can effectively accommodate the position deviation of the various components as a result of production and assembly tolerances. As such, the brake shoes 71 can be in complete contact with the flywheel 34, thereby ensuring effective adjustment of resistance and effective braking.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A resistance adjustment device for an exercise apparatus, the exercise apparatus including a front support frame having two fixed upright rods, a rear support frame, a handle assembly mounted on the front support frame, a flywheel mounted rotatably between the upright rods of the front support frame, a seat assembly mounted on the rear support frame, and a pedal unit for actuating rotation of the flywheel, said resistance adjustment device comprising:

first and second swing arms adapted to be connected pivotally and respectively to the upright rods of the front support frame and adapted to flank the flywheel, said first and second swing arms being rotatable toward and away from the flywheel;

two biasing units, each of which is adapted to be disposed between a respective one of the upright rods and a respective one of said first and second swing arms so as to bias said first and second swing arms to rotate away from the flywheel;

two brake devices connected respectively to said first and second swing arms and located on two sides of the flywheel;

a first adjustment unit having an adjustment knob adapted to be mounted rotatably on the front support frame, a tubular first guiding member connected fixedly to said first swing arm, a first fixing member connected fixedly to said second swing arm, and a first cable fastened to said adjustment knob at one end and to said first fixing member at another end, said first cable having an intermediate portion extending through said first guiding member; and a second adjustment unit including a brake lever adapted to be mounted operably on the handle assembly, a tubular second guiding member connected fixedly to said second swing arm, a second fixing member connected fixedly to said first swing arm, and a second cable fastened to said brake lever at one end and to said second fixing member at another end, said second cable having an intermediate portion extending through said second guiding member;

wherein when said adjustment knob is operated, said first cable can be loosened and pulled so that said first and second swing arms can move said brake devices away from and toward the flywheel, thereby adjusting magnitude of resistance to rotation of the flywheel; and wherein when said brake lever is operated, said second cable can be swiftly pulled so that said first and second swing arms can move said brake devices toward the flywheel so as to clamp the flywheel to effect an instant brake.

2. The resistance adjustment device of claim 1, wherein said second adjustment unit further includes a guide seat adapted to be mounted fixedly on the front support frame for extension of said second cable therethrough to ensure smooth movement of said second cable.

3. The resistance adjustment device of claim 1, wherein each of said first and second swing arms is formed with a fixed vertical mounting plate that has a vertically extending slot formed therethrough, each of said brake devices including a brake shoe having a side surface formed with a groove, and a bolt and nut assembly connected fixedly to the respective one of said first and second swing arms, said bolt and nut assembly of each of said brake devices including a bolt having a transverse blocking plate, a non-threaded insert portion that extends integrally and axially from one side of said blocking plate and that is inserted fittingly into said groove in said brake shoe, and a threaded shank portion that extends integrally and axially from the other side of said blocking plate and that extends through said slot in said mounting plate of the respective one of said first and second swing arms, said bolt and nut assembly of each of said brake devices further including a nut engaging said shank portion of said bolt so as to clamp said mounting plate of the respective one of said first and second swing arms between said blocking plate and said nut.

4. The resistance adjustment device of claim 3, wherein said insert portion of each of said bolts has a semi-spherical outer end surface, said groove in each of said brake shoes having a semi-spherical contour that corresponds to said outer end surface of said insert portion of the respective one of said bolts.

5. The resistance adjustment device of claim 1, wherein each of said brake devices includes a brake shoe having a side surface formed with a groove, and an insert piece which is formed integrally with the respective one of said first and second swing arms, and which is inserted into said groove in said brake shoe so that said brake shoe is confined between said insert piece and the flywheel.

6. The resistance adjustment device of claim 5, wherein each of said insert pieces has a semi-spherical outer end surface, said groove in each of said brake shoes having a semi-spherical contour that corresponds to said outer end surface of the respective one of said insert pieces.

* * * * *